United States Patent [19]

Bromley

[11] 4,252,510

[45] Feb. 24, 1981

[54] DIAPHRAGM PUMP

[75] Inventor: Bruce A. Bromley, 7 Elmwood Ave., Longmeadow, Mass. 01106

[73] Assignee: Bruce A. Bromley, Longmeadow, Mass.

[21] Appl. No.: 937,528

[22] Filed: Aug. 28, 1978

[51] Int. Cl.[3] ..... F04B 21/02; F04B 39/10

[52] U.S. Cl. ..... 417/534

[58] Field of Search ..... 417/534–537, 417/521, 397

[56] References Cited

U.S. PATENT DOCUMENTS

| | | | |
|---|---|---|---|
| 862,867 | 8/1907 | Eggleston | 417/472 |
| 915,994 | 3/1909 | Myers | 417/536 |
| 1,062,375 | 5/1913 | Tyson | 417/536 |
| 1,308,814 | 7/1919 | Sidenstricker et al. | 417/521 |
| 1,965,497 | 7/1934 | Johnson | 417/537 |
| 2,552,703 | 5/1951 | Alowso | 417/536 |
| 3,039,399 | 6/1962 | Everett | 417/536 |
| 3,151,778 | 10/1964 | Olney et al. | 417/568 |
| 3,782,863 | 1/1974 | Rupp | 417/397 |
| 4,123,204 | 10/1978 | Scholle | 417/397 |

FOREIGN PATENT DOCUMENTS

| | | | |
|---|---|---|---|
| 50027 | 1/1919 | Denmark | 417/537 |
| 296027 | 2/1916 | Fed. Rep. of Germany | 417/536 |
| 2726674 | 5/1978 | Fed. Rep. of Germany | 417/397 |
| 711476 | 9/1931 | France | 417/537 |

*Primary Examiner*—William L. Freeh

*Attorney, Agent, or Firm*—Chapin, Neal & Dempsey

[57] ABSTRACT

A diaphragm pump for use with corrosive fluids. The pump comprises a pair of opposed fluid chambers each defined in part by a flexible diaphragm. The pump also includes means for reciprocally driving the diaphragms and inlet and outlet check valves. The unique structure of the pump allows all wetted components thereof to be economically formed from a substantially chemically inert material such as polytetrafluoroethylene and the like.

13 Claims, 6 Drawing Figures

DIAPHRAGM PUMP

BACKGROUND

This invention relates to diaphragm pumps and more particularly to such pumps for use with corrosive fluids.

A major drawback of many popular industrial pumps, i.e., piston, impeller or the like is that such pumps employ relatively movable seals and bearings in a compressive means in an attempt to protect and/or separate the pump drive means from the fluid handled by the pump. Not only must such seals and bearings be routinely repaired or replaced due to normal wear and tear thereof, these components often exhibit accelerated wear and failure where the pump is required to handle corrosive fluids.

Diaphragm pumps have been employed in industrial applications for use with chemically aggressive and/or corrosive fluids with limited success. While such pumps employ as pumping members diaphragms fixedly sealed about the perimeter thereof, therefor requiring no movable seals or bearings, various other of the pump components being formed from conventional materials subject to premature failure from attack by corrosive fluids render such prior art diaphragm pumps not entirely suitable for use with corrosive fluids.

Although certain relatively inert materials such as polypropylene and polytetrafluoroethylene are known to be able to withstand exposure to many corrosive industrial fluids, the strength of such materials has heretofore limited their use in industrial pumps to linings for the various wetted pump components. Thus, diaphragm pumps such as that disclosed in U.S. Pat. No. 3,000,320 to Ring for handling corrosive fluids are required to have all the wetted components thereof formed from structural material such as steel and the like lined with a suitable chemically inert material as by coating, molding or laminating techniques.

Accordingly, it is a principal object of the present invention to provide a diaphragm pump which overcomes the deficiencies of the prior art.

It is another object of the present invention to provide a diaphragm pump capable of handling corrosive fluids without risk of corrosive attack of the pump by the fluid.

It is another object of the present invention to provide a diaphragm pump for handling corrosive fluids wherein the pump is formed entirely from chemically inert materials.

It is yet another object of the present invention to provide a diaphragm pump for handling corrosive fluids, the pump being economic to manufacture.

DESCRIPTION OF THE DRAWINGS

These and other objects will become more apparent from the following detailed description taken in connection with the accompanying drawings wherein:

FIG. 3 is an elevated front view of the pump partially sectioned and broken away;

DESCRIPTION OF THE PREFERRED EMBODIMENT

Figure 6:
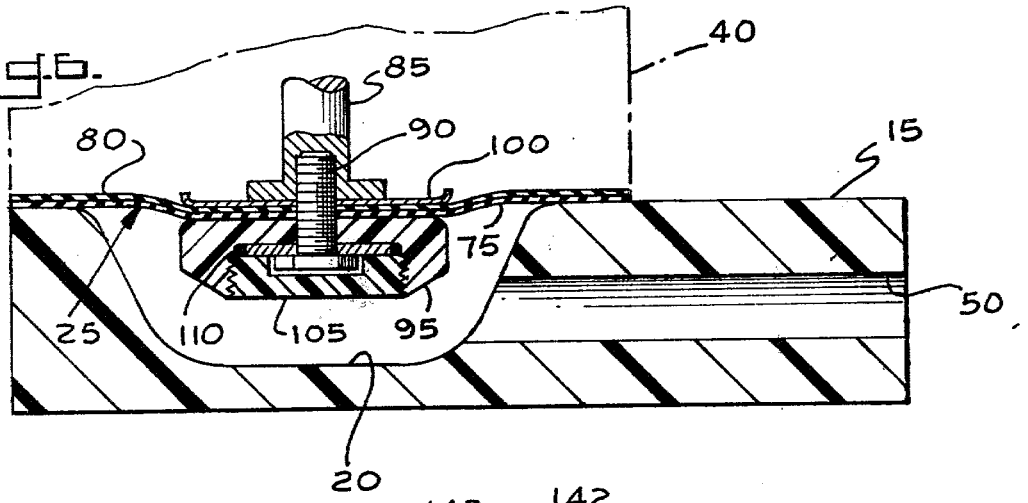
FIG. 6 is a sectional view taken along line 5—5 of FIG. 4.

Referring to the drawings, the diaphragm pump of the present invention illustrated generally at 10, comprises a pair of end caps 15 each housing a fluid chamber 20 defined in part by a flexible diaphragm 25 (FIG. 6). The fluid chambers communicate with inlet check valve means 30 and outlet check valve means 35 disposed between the end caps. The diaphragms are reciprocally driven by any suitable drive means 40 powered by air or any equivalent medium and also disposed between the end caps. In the preferred embodiment, the pump structure is such that all wetted or fluid contacting components thereof are formed entirely of a nonmetallic and chemically inert material such as but not limited to PVC, CPVC, polycarbonate, polypropylene or polytetrafluoroethylene sold by E. I. DuPont de Nemours and Co. under the trademark TEFLON without a sacrifice in strength. For ease in portability the pump may be provided with a handle 45 fixed thereto at any convenient location.

Each end cap 15 comprises a unitary member or block of the hereinabove described chemically inert material having a concave depression or fluid chamber 20 formed therein as by any appropriate machining or molding techniques. Each of the fluid chambers has extending from the side surface thereof a pair of extension passages 50 and 55. Each pair of extension passages provides communication between the corresponding fluid chamber and a pair of adjacent inlet and outlet check valves. In the preferred embodiment, the extension passages are formed by drilling or boring from an edge of the cap and sealing as with threaded plug 60. Each of the extension passages opens to the inner surface of the cap for connection to the check valves at elongate openings 65 which ensure proper connection with the check valves despite some misalignment between the check valves and the end caps. The end caps are bored axially therethrough about the periphery of the fluid chambers at locations of connection with the check valves, the bores receiving through bolts 70 or similar fastening means for maintaining the check valves, diaphragms and drive means in fixed, clamped, engagement between the caps.

Diaphragm 25, as best illustrated in FIG. 6, is of a two-ply construction comprising an outer ply 75 which contacts the fluid handled by the pump and is thus formed from a sheet of the chemically inert material discussed above. To provide added flexibility to the diaphragm, the outer ply is backed by an inner elastomeric ply 80 of neoprene or similar material which is isolated from contact with any corrosive fluids by the outer ply. The diaphragms are sealed from leakage about the peripheries thereof, by a fixed clamped engagement between the end cap and the housing for drive means 40. Such a fixed corrosion resistant seal, unlike relatively movable seals or packing, requires little or no maintenance and prevents leakage of fluid into the drive means.

The diaphragms are fixed to the drive means by any suitable means. In the preferred embodiment, drive means 40 is provided with an interiorly threaded reciprocating shaft 85 which receives a threaded stud 90.

The threaded stud fixes a hub 95 and back plate 100 with the diaphragm clamped therebetween to the shaft such that reciprocal drive motion of the shaft causes a corresponding reciprocal diaphragm motion. The hub is, of course, contacted by the pumped fluid within chamber 20 and is, therefore, formed of the corrosion resistant material described above. In that it may be desirable to form stud 90 from steel or other corrosible material, the head thereof is sealed from the pumped liquid by disposition within a threaded cavity in the hub, the cavity being sealed closed by threaded cap 105 and interior O-ring 110.

As set forth hereinabove, drive means 40 may be of any suitable variety capable of simultaneously moving the diaphragm in a reciprocal rectilinear fashion. In the preferred embodiment, driven means 40 includes a compressed air powered reciprocating slide valve but alternate drive means will suggest themselves to those skilled in the art. Therefore, it will be understood that as one diaphragm is moved in a compressive stroke (toward the interior of the corresponding fluid chamber), the other is moved in a suction stroke (away from the interior of the corresponding fluid chamber).

Figure 4:
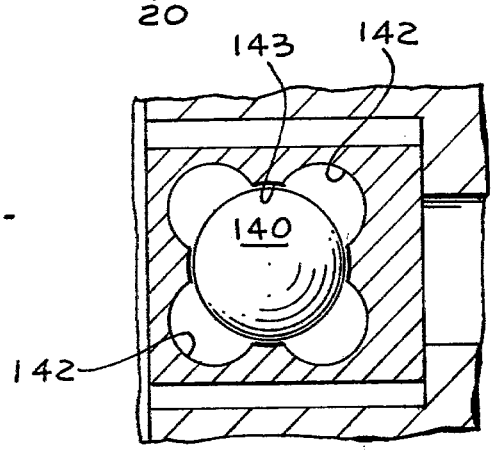
FIG. 4 is a sectional view taken in the direction of line 4—4 of FIG. 3.

Fluid is drawn into each fluid chamber through the corresponding inlet extension passage 55 from the inlet check valve means 30. The inlet check valve means includes a pair of inlet check valves 112 each disposed adjacent the inlet extension passage 55 in the corresponding end cap and comprising in part a single valve cage 115 having a longitudinally extending passage 120 formed in the interior thereof, passage 120 providing communication between a main pump fluid inlet 125 and the check valves, the inlet being formed approximately in the center of cage 115 and extending generally transverse to the longitudinal axis thereof. Passage 120 is most conveniently formed by drilling or boring through the cage and plugging the passage opening as with threaded plug 130. The end portions of the side of cage 115 have inlet valve chambers 135 formed therein, the chambers receiving spherical inlet valve elements 140 and being open at the bottom for communication with passage 120. As best seen in FIG. 4, each valve chember is of generally clover-leaf cross section being formed from the intersection of four generally cylindrical corner bores 142 which allow flow around the valve element and a central bore 143 which provides a vertical track in which the valve element moves. Each chamber has a valve seat 145 formed about the bottom opening, the seats being generally of a spherical contour. Inlet valve chambers 135 communicate at the tops thereof with elongate openings 65 and extension passages 55 in caps 15 over sloped, recessed portions 150 of the cage ends. Inlet valve chambers 135 are enclosed by inlet valve housings 155 comprising open ended sleeves which receive the end portions of the inlet valve cage, defining the upper portion of the inlet valve chamber. The inlet valve housings may be sealed to the inlet valve cage and end caps by means of O-rings 160 seated in recesses in the ends of the housings.

Figure 1:
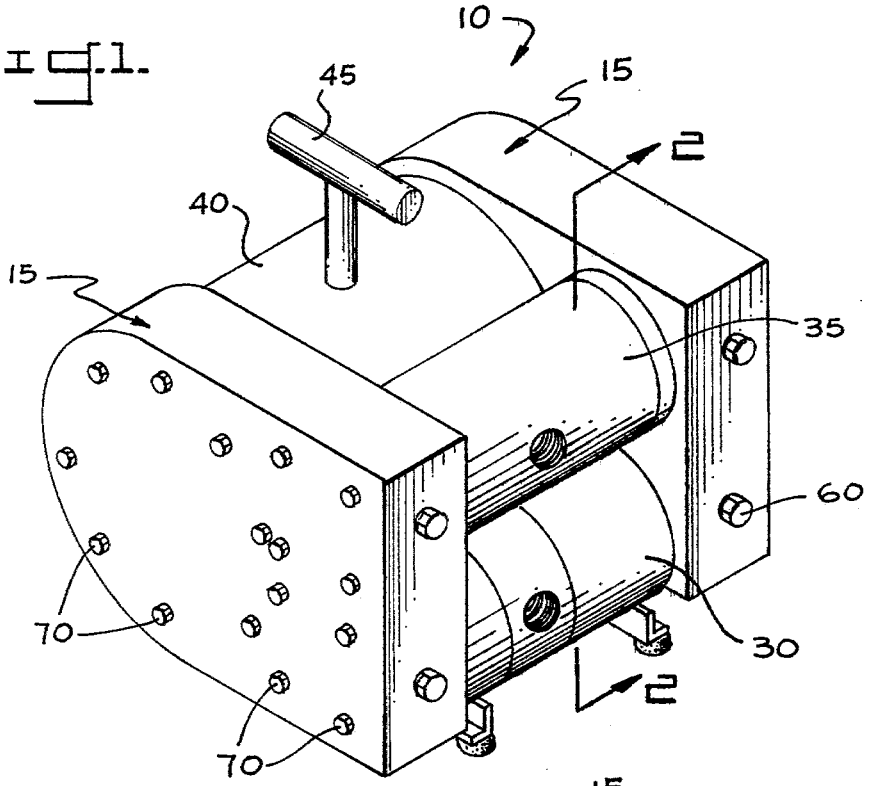
FIG. 1 is an isometric view of the pump of the present invention.
Figure 2:
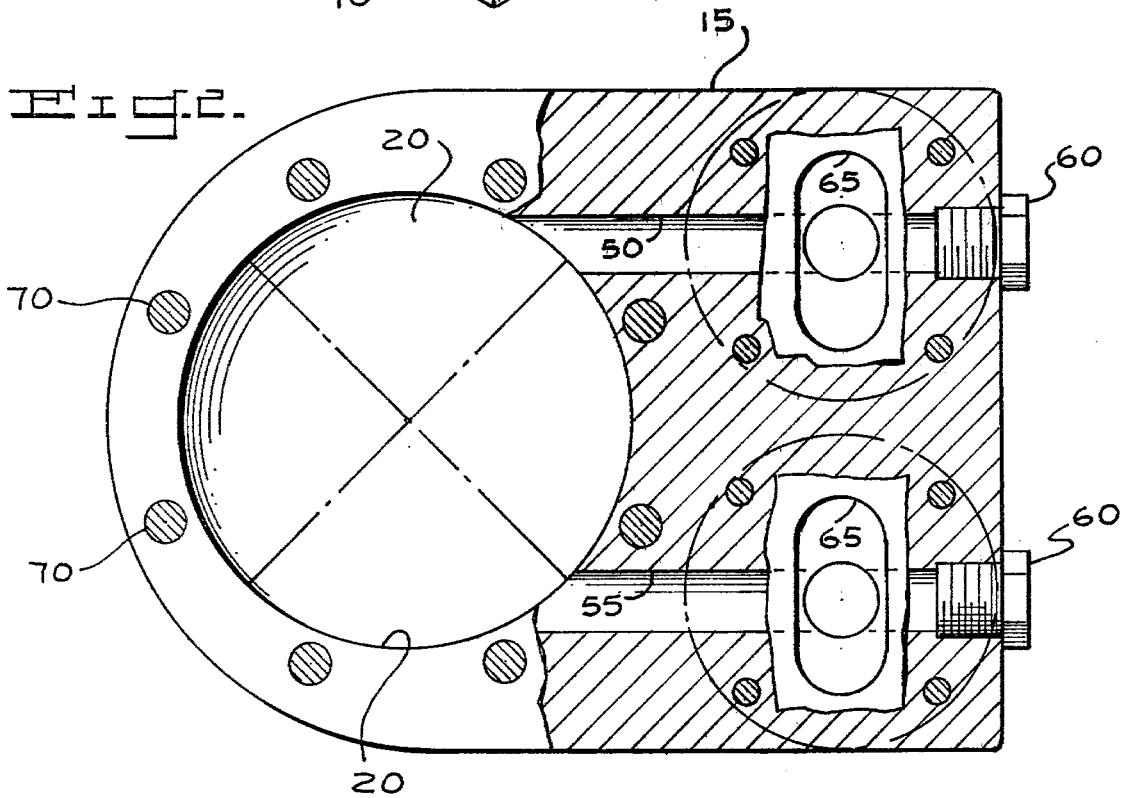
FIG. 2 is a sectional view of the pump taken in the direction of line 2—2 of FIG. 1 and partially broken away to show details of construction.
Figure 2:
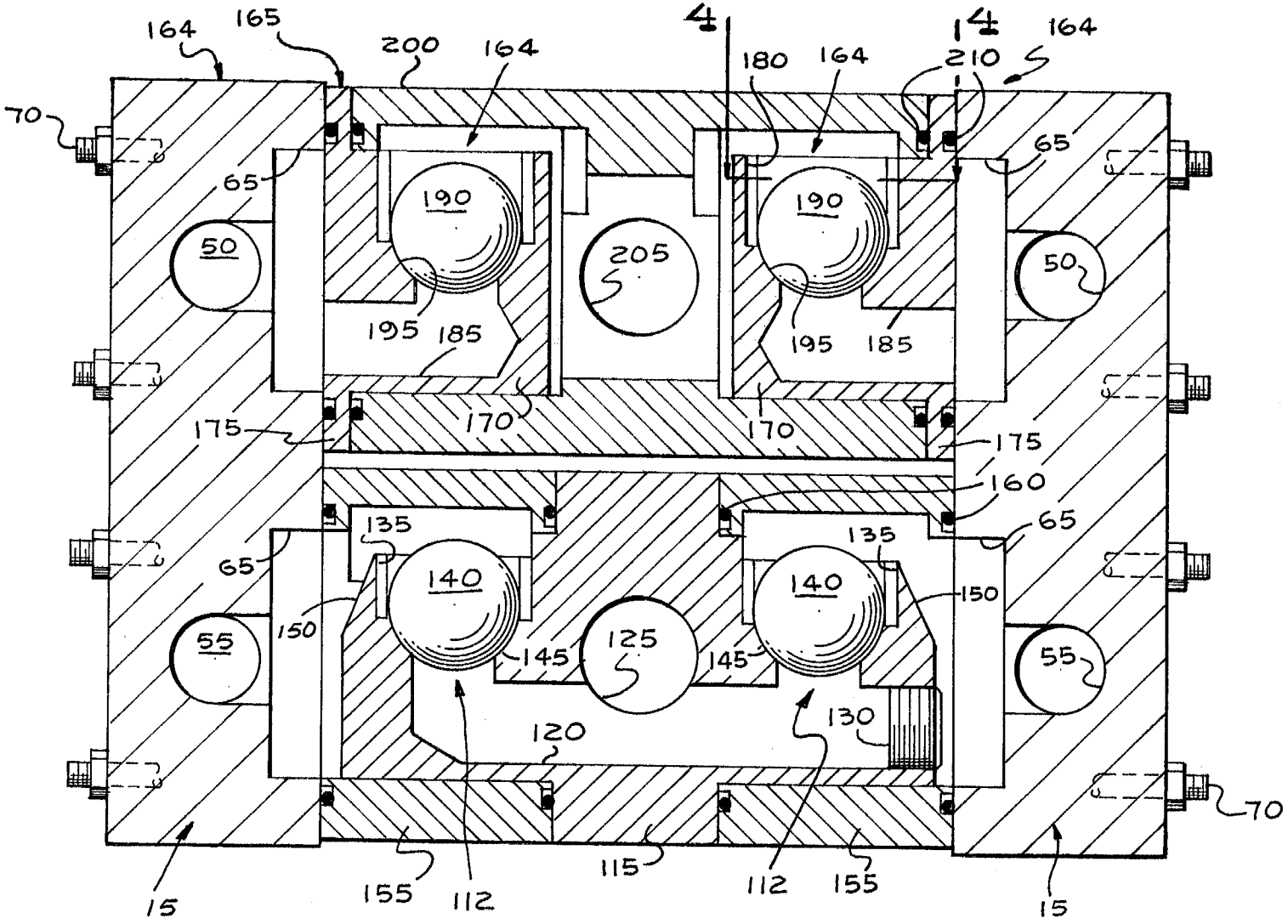
Figure 5:
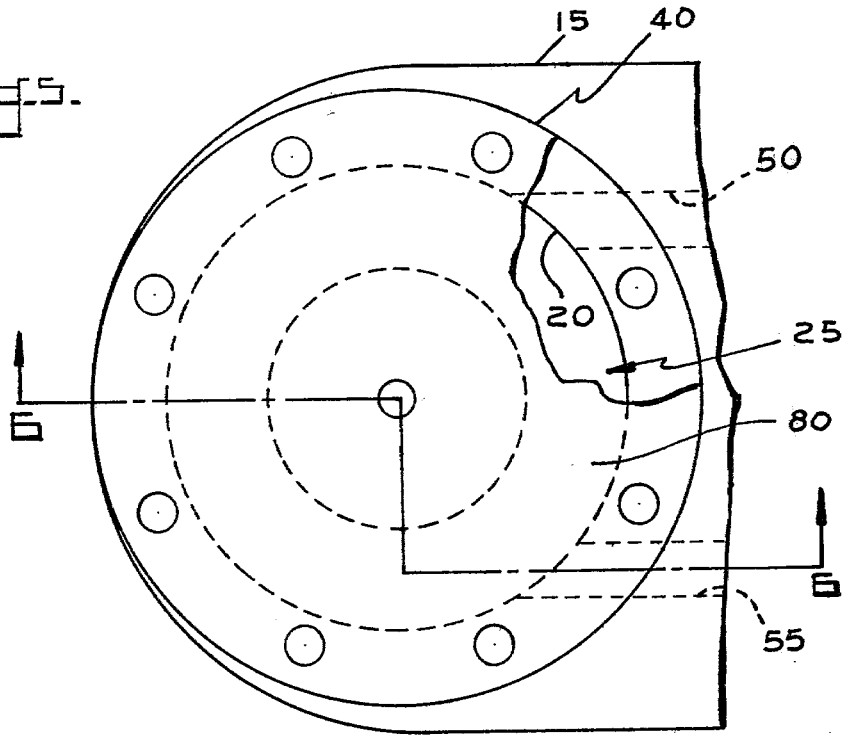
FIG. 5 is a fragmentary view of one of the fluid chambers of the pump.

The inlet check valve housings, cages and valve elements are formed entirely of the chemically inert, corrosion resistant material discussed above. The inlet cage and housings may be drilled or bored longitudinally in alignment with the holes in the end caps whereby the inlet check valves are maintained in fixed clamped engagement between the end caps by means of through-bolts 70. As best seen in FIG. 1, inlet valve cage 115 may be provided with an enlarged central portion 162 for enhanced strength and to define, with housings 155, a smooth cylindrical outer surface.

Outlet valve means 35 comprises a pair of outlet check valves 164 each of which includes a valve cage 165 having a shank portion 170 and an end plate 175. The shank portion includes an outlet valve chamber 180 formed in the side thereof, the chamber being open at the bottom thereof for communication with longitudinal passage 185. Passage 185 provides communication with an adjacent one of the fluid chambers 20 through opening 65 and outlet extension passsage 50 in end cap 20. Outlet valve chamber 180 receives a spherical valve element 190 which is normally seated on conforming seats 195 surrounding the opening in the valve chamber bottom and while not specifically shown is of generally the same clover-leaf shape as the inlet valve chambers.

The outlet valve cages are received within the ends of outlet check valve housing 200 comprising a sleeve which through the interior thereof, provides communication between the outlet check valves and the main pump outlet 205. The outlet valve housing is of a diameter substantially equal to that of the end plates whereby the outer surface of the outlet check valve means is smoothly cylindrical for ease in cleaning dirt and contaminants therefrom. The outlet cases are sealed to the housing and end caps by means of O-rings 210. The outlet valve cages housing and valve elements are formed from the above described chemically inert material and the outlet valve means is fixed between the end caps by means of through bolts 70 extending through longitudinal holes in the cases and housing.

It will thus be appreciated that the diaphragm pump of the present invention exhibits an economy of manufacture in that excluding the stationary O-rings, bolts, and the drive means, the pump comprises only twelve component parts. This structure is characterized by a strength which allows the pump to be formed entirely from chemically inert materials heretofore thought to be inherently too weak for such structural purposes. Being so constructed, the pump is entirely free from risk of attack by most industrial corrosive fluids, is self-priming and can handle fluids with excessive particulate matter therein with little risk of fouling.

Operation of the pump is as follows: When one of the diaphragms is driven in a compressive stroke, fluid in the corresponding chamber 20 is forced through extension passage 50, forcing an adjacent outlet check valve off its seat allowing the fluid to flow through this valve to the main pump outlet 205. The pressurized fluid forces the adjacent inlet valve closed, thereby preventing any fluid discharge through the main inlet passage. During this compression stroke, the opposite diaphragm is driven in a suction stroke described next.

On the opposite stroke of the drive means, this diaphragm will be driven in a suction stroke whereby the adjacent inlet valve element is lifted off its seat allowing fluid to fill fluid chamber 20 from the main pump inlet through the inlet valve and extension passage 55 while the adjacent outlet valve element remains seated blocking communication between the chamber 20 and the pump outlet. During this suction stroke, the opposite diaphragm is now moved in a compression stroke described hereinabove.

What is claimed is:

1. A pump comprising:

a pair of spaced fluid chambers each being defined in part by a flexible diaphragm;

means for reciprocally driving said diaphragms such that each is driven in a compression stroke while the other is driven in a suction stroke;

a pair of inlet check valves each being disposed within an inlet passage between one of said fluid chambers and a main pump inlet, each inlet check valve including a valve element received within an end of an inlet valve cage having a passage therethrough providing communication between said inlet valves and said fluid inlet, each of said inlet valve cage ends being received within an inlet valve housing in sealing engagement therewith, said valve housing comprising an open ended sleeve;

each of said inlet valve cages comprising an elongate member having valve element receiving chambers formed in opposite end portions of the lateral surface thereof, each chamber being defined in part at the bottom thereof with a seat conforming to said valve element, said inlet valve cage passage being disposed longitudinally of said inlet valve cage and communicating with said inlet check valve chamber at said valve seats;

said inlet check valves communicating with said fluid chambers through the top of said inlet valve chambers and the interior of said sleeves;

a pair of outlet check valves each being disposed within an outlet passage between one of said fluid chambers and a main pump outlet, each outlet check valve comprising an outlet valve cage having a passage therein providing communication between the outlet check valve and one of said fluid chambers, and further comprising an outlet valve element received within said outlet valve cage, said outlet valve cages being received within opposite ends of an outlet valve housing in sealing engagement therewith; and, said inlet and outlet passages being substantially separate passages.

2. The pump according to claim 1 wherein said diaphragms, fluid chambers and check valves are formed from a substantially chemically inert material.

3. The pump according to claim 2 wherein said chemically inert material comprises polytetrafluoroethylene.

4. The pump according to claim 2 wherein said chemically inert material comprises polypropylene.

5. The pump according to claim 1 wherein said inlet valve elements are spherical.

6. The pump according to claim 1 wherein each of said diaphragms comprises an outer ply adapted for contacting a pumped fluid and a backing ply disposed contiguous with said outer ply, said backing ply being of a flexibility substantially greater than said outer ply.

7. The pump according to claim 6 further including a pair of hubs each fixed to one of said diaphragms at the center thereof, each hub including an outer member in contact with one of said outer plies, said outer ply and said outer member being formed from a substantially chemically inert material, said outer member including a recess therein, said recess receiving means connecting said hub with said driving means, and being sealed closed whereby said connecting means is sealed from any corrosive fluid within said fluid chamber.

8. The pump according to claim 7 wherein said chemically inert material comprises polytetrafluoroethylene and said backing ply comprises an elastomer.

9. A pump comprising:

a pair of spaced fluid chambers each being defined in part by a flexible diaphragm;

means for reciprocally driving said diaphragms such that each is driven in a compression stroke while the other is driven in a suction stroke;

a pair of inlet check valves each being disposed within an inlet passage between one of said fluid chambers and a main pump inlet, each inlet check valve including a valve element received within an end of an inlet valve cage having a passage therethrough providing communication between said inlet valves and said fluid inlet, each of said inlet valve cage ends being received within a generally annular inlet valve housing in sealing engagement therewith;

each of said inlet valve cages comprising an elongate member having valve element receiving chambers formed in opposite end portions of the lateral surface thereof, each chamber being defined in part at the bottom thereof with a seat conforming to said valve element, said inlet valve cage passage being disposed longitudinally of said inlet valve cage and communicating with said inlet check valve chamber at said valve seats;

said inlet valve cages including an enlarged cylindrical central portion of a diameter approximately equal to that of said inlet valve housings whereby the assembled inlet valve cages and housings are of generally cylindrical shape;

a pair of outlet check valves each being disposed within an outlet passage between one of said fluid chambers and a main pump outlet, each outlet check valve comprising an outlet valve cage having a passage therein providing communication between the outlet check valve and one of said fluid chambers, and further comprising an outlet valve element received within said oulet valve cage, said outlet valve cages being received within opposite ends of an outlet valve housing in sealing engagement therewith; and, said inlet and outlet passages being substantially separate passages.

10. The pump according to claim 1 wherein each of said fluid chambers is disposed in a pump end cap, each of said end caps further including first and second chamber extension passages extending from said chamber to an interior surface of said end cap, said inlet and outlet check valves being fixed to said end caps therebetween such that connection to each of said check valves from a corresponding one of said fluid chambers is made through one of said chamber extension passages.

11. The pump according to claim 10 wherein said diaphragms are disposed in sealing engagement with the interior surfaces of said end caps about the periphery of said fluid chambers, and said diaphragm drive means is disposed between said end caps being fixed thereto at the inner surfaces thereof about the periphery of said fluid chamber.

12. A pump comprising:

a pair of spaced fluid chambers each being defined in part by a flexible diaphragm;

means for reciprocally driving said diaphragms such that each is driven in a compression stroke while the other is driven in a suction stroke;

a pair of inlet check valves each being disposed within an inlet passage between one of said fluid chambers and a main pump inlet, each inlet check valve including a valve element received within an end of an inlet valve cage having a passage therethrough providing communication between said inlet valves and said fluid inlet, each of said inlet valve cage ends being received within an inlet valve housing in sealing engagement therewith;

a pair of outlet check valves each being disposed within an outlet passage between one of said fluid chambers and a main pump outlet, each outlet check valve comprising an outlet valve cage having a passage therein providing communication between the outlet check valve and one of said fluid chambers, and further comprising an outlet valve element received within said outlet valve cage, said outlet valve cages being received within opposite ends of an outlet valve housing in sealing engagement therewith, said valve housing comprising an open ended sleeve;

each outlet valve cage comprising an end plate and a shank of reduced diameter extending therefrom, said shank portion having a valve element receiving chamber formed in the lateral surface thereof, said chamber being defined in part at the bottom thereof by a seat conforming to said valve element, said outlet valve cage passage communicating with said outlet check valve chamber at said outlet check valve seat;

each of said outlet check valves communicating with said main pump outlet through the top of one of said outlet valve chambers and the interior of one of said sleeves; and, said inlet and outlet passages being substantially separate passages.

13. The pump according to claim 12 wherein said outlet valve elements are spherical.

* * * * *